United States Patent [19]

Foy

[11] 4,392,648

[45] Jul. 12, 1983

[54] THEATRICAL TRANSPORTATION APPARATUS

[76] Inventor: Peter S. Foy, 4345 Topaz St., Las Vegas, Nev. 89121

[21] Appl. No.: 266,925

[22] Filed: May 26, 1981

[51] Int. Cl.[3] ..... A63J 5/12

[52] U.S. Cl. ..... 272/24; 212/74

[58] Field of Search ..... 272/22, 24, 21; 212/74, 212/94, 133

[56] References Cited

U.S. PATENT DOCUMENTS 2,049,641 8/1936 De Wolfe ..... 212/94

3,476,385 11/1969 Foy ..... 272/24

FOREIGN PATENT DOCUMENTS 146279 3/1950 Australia ..... 212/94

*Primary Examiner*—Richard C. Pinkham

*Assistant Examiner*—Stephen R. Crow

*Attorney, Agent, or Firm*—Roger A. Marrs

[57] ABSTRACT

A personnel transportation apparatus is disclosed herein for positioning a performer across a stage in view of an audience which includes an elongated stationary support having an upper and a lower set of rails for rollably supporting a first and a second carriage respectively. A first pulley system operably moves the first carriage along the upper rails between the opposite ends of the support to transport the performer across the stage while a second pulley system drives the second carriage along the lower rails which moves in the opposite direction to the first carrier and moves twice the distance. A third pulley system interconnects the first and second carriages for controlling the performers height above the stage as the performer travels across the stage. Independant control of horizontal travel and vertical height of the performed is established.

6 Claims, 4 Drawing Figures

THEATRICAL TRANSPORTATION APPARATUS

BACKGROUND OF THE INVENTION

1. Field of the Invention

The present invention relates to personnel transporting apparatus and more particularly to a novel theatrical personnel carrier or transportation rig adapted to vertically and transversely position or locate a performer across a staging area in order to acheive special theatrical and illusionary effects for the benefit of a viewing audience.

2. Brief Description of the Prior Art

In the entertainment industry, it is often times necessary to transport acting personnel above a stage to represent the appearance of unsupportive suspension simulating the effects of flying, hoving, swimming or other similar special effects. Representative of such theatrical requirements are found in programming flying ballets, swimming effects for motion pictures, the performance of well known plays such as "Peter Pan" and other forms of theatrical presentation.

Various conventional overhead trolley and conveyer systems which suspend the performer from the end of a wire have been employed in the past to lift and transport acting personnel about a stage and which have employed simple pulley and line arrangements. Such a system or apparatus is disclosed in my prior U.S. Pat. No. 3,476,385. However, various problems and difficulties have been encountered with such prior systems which stem largely from the fact that precision maneuvering and orientation of the actor or performer about the stage cannot be properly acheived in a satisfactory manner which is realistic, convenient and safe for the performer. In one system, the performer may be readily lifted from the stage floor but substantial swinging of the performer is encountered which greatly hampers precise maneuvering and prevents the desirable feature of spotting a swinging performer at a particular point or spot on the stage. In other prior systems, the performer may be precisely maneuvered but a substantial portion of the conveying or transportation equipment is exposed to the view of the audience which, obviously, negates the theatrical illusion intended to be presented. Also, twisting of the pulley system lines sometimes occurs which jams the pulleys and requires additional attention and handling.

Perhaps one of the more glaring defects in prior or conventional theatrical transportation systems resides in the inability of the system to transport the performer across the stage at a varible height from the floor of the stage. Normally, as the performer traversers laterally across the stage, the pulleys change dimension as the carriages travel so that the performer either desends or ascends along a sloping line rather than at a desired height. This is a distinct disadvantage in many of the required theatrical performances.

Therefore, a long standing need has desired to provide a suitable apparatus for carrying a performer across the stage so as to give the illusion of flying at a selected height throughout the length of travel from one side of the stage to the other. Also, means need to be provided for permitting independent controlled travel of the performer across the length of the stage while providing independant control of the performers height above the floor of the stage.

SUMMARY OF THE INVENTION

Accordingly, the above problems and difficulties are obviated by the present invention which incorporates a stationary overhead support having an upper and a lower set of rails for rollably supporting a first and a second carriage means respectively. A first pulley system drives the first carriage means along the upper rails between the opposite ends of the support so as to transport the performer across the stage while a second pulley system drives the second carriage along the lower rails which moves in the opposite direction to the first carrier means whereby movement is twice the distance of the first carrier means. A third pulley system interconnects the first and second carriages for controlling the performers height above the stage so that a flight of a desired height is maintained as the performer travels across the stage.

Therefore, it is among the primary objects of the present invention to provide a novel personnel transportation apparatus for acheiving special theatrical effects which are capable of transporting an actual performer in a viewing plane at a desired height about a staging area in such a fashion that precise traverse and vertical movement can be acheived.

Another object of the present invention is to provide a novel personnel transportation apparatus for use in connection with theatrical performances wherein the apparatus will independantly conduct or transport the performer about the stage at a desired height and horizontal length wherein the component parts of the apparatus may be hidden from the view of the audience.

Still another object of the present invention is to provide a novel personnel flying rig which employs a movable carriage for not only effecting tranverse movement of the performer in mid air about a staging area but which insures that the performer may be lowered or lifted to a desired height throughout the length of travel.

Still another object of the present invention is to provide a novel personnel flying rig which employs a pair of rectilinear movable carriages depending from a pair of rail sets on a stationary support which are separately operated by pulley systems to position a performer suspended by a wire or line about a vertical viewing plane so as to acheive various theatrical and illusionary effects.

BRIEF DESCRIPTION OF THE DRAWINGS

The features of the present invention which are believed to be novel are set forth with particularly in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENT

Figure 1:
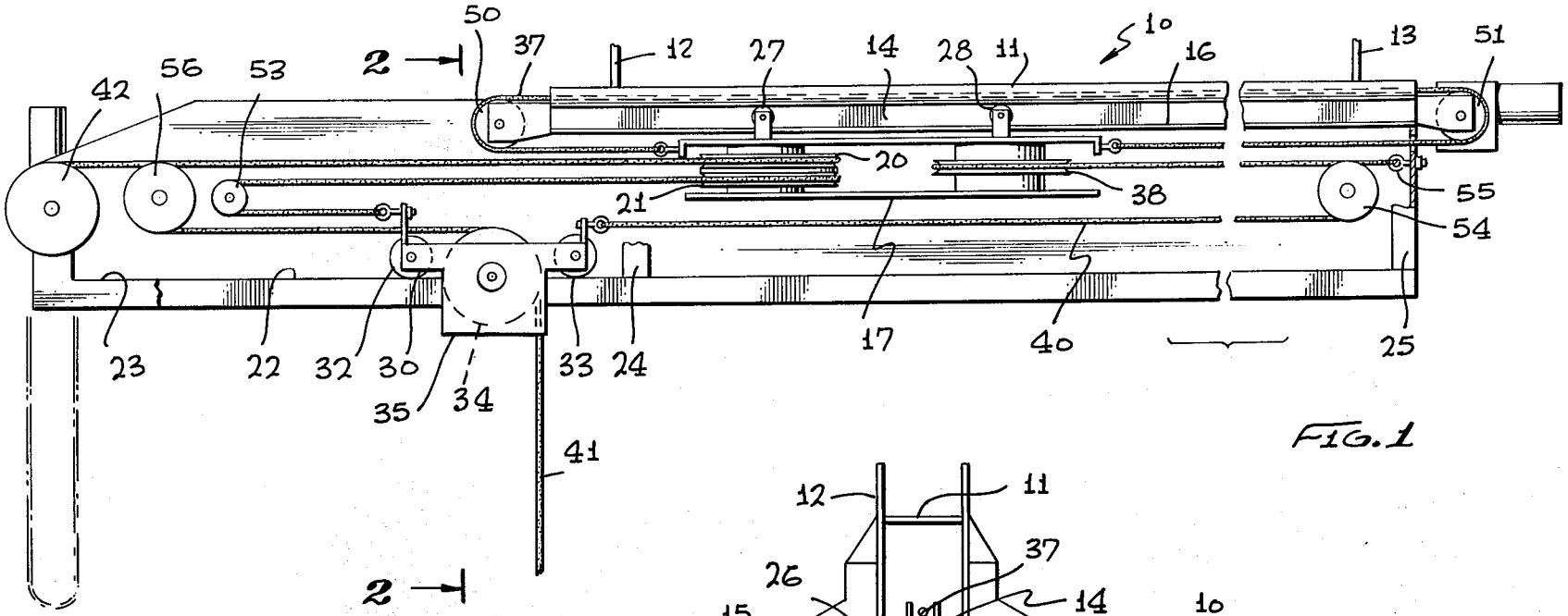
FIG. 1 is a side elevational view of the novel personnel transportation apparatus of the present invention illustrating the separate means for effecting vertical and lateral positioning of a person suspended from a wire within the confines of a typical staging area.
Figure 2:
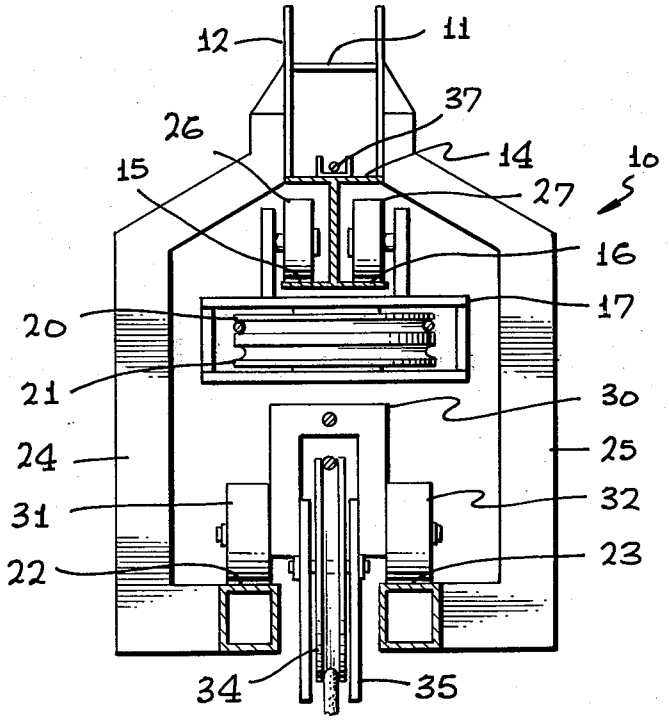
FIG. 2 is a tranverse cross-sectional view of the first and second carriage means included in the system shown in FIG. 1 as taken in the direction of arrows 2—2 thereof.

Referring to FIG. 1 and 2, a personnel transportation apparatus employed for theatrical productions in accordance with the present invention is illustrated as indicated in the general direction of arrow 10. The apparatus is illustrated in connection with the supporting of and for achieving the positioning of a performer (not shown) in a vertical viewing plane which is exposed to an audience. In actual operation, the viewing area may be defined by curtain, scenery, camera view finders or the like so that the apparatus of the present invention is completely hidden when not in use and when the apparatus is being employed for performer positioning during performances such as flying ballets or similar theatrical special effects.

In general, the present invention includes an elongated stationary support 11 which is fixed to suitable structural securement such as by means of brackets 12 and 13. The stationary support 11 further includes an I-beam indicated by numeral 14 which provides an upper set of rails or tracks indicated by numeral 15 and 16 respectively. The upper rails rollably support a first carriage means indicated by numeral 17 which supports a pair of independent pulleys 20 and 21 respectively. FIG. 2 more clearly illustrates the first carriage means and further illustrates a second set of rails indicated by numerals 22 and 23 respectively. The lower rails are supported from downwardly depending beams such as beams 24 and 25 downwardly depending from the stationary support 11.

It can be seen from FIGS. 1 and 2 that the first carriage means 17 is rollably supported on the upper track set by means of rollers 26 and 27 respectively which form a first set of rollers for supporting the carriage means. A second set is illustrated in FIG. 1 by the numeral 28.

A second carriage means is indicated by numeral 30 which is rollably supported on the lower rail set by means of rollers 31 and 32 forming a first roller set and by a second roller set indicated by numeral 33 in FIG. 1. The second carriage means 30 includes a single pulley 34 which is rotatably carried between a sheave 35.

The transportation apparatus 10 is a track system for transportating performers in the air to give the illusion of flying. The double rail or track carried on the elongated stationary support 11 carries the first carriage means on the upper rails or track which travels along the track being propelled by mechanical or manual means via a cable drive wherein the cable is indicated by numeral 37. In turn, the first carrier means 17 includes three pulleys indicated by numerals 20, 21 and 38 which controls the movement of the second carriage means 30 via a cable indicated by numeral 40. A third cable, indicated by numeral 41, supports the person being transported across the stage. The second carriage means 30 is slaved to the movement of the first carriage means via the cable 40 while the pulley 20 about which the cable 41 is trained terminates in a take-up drum 42 which controls the height of the performer above the floor of the stage.

Figures 3, 4:
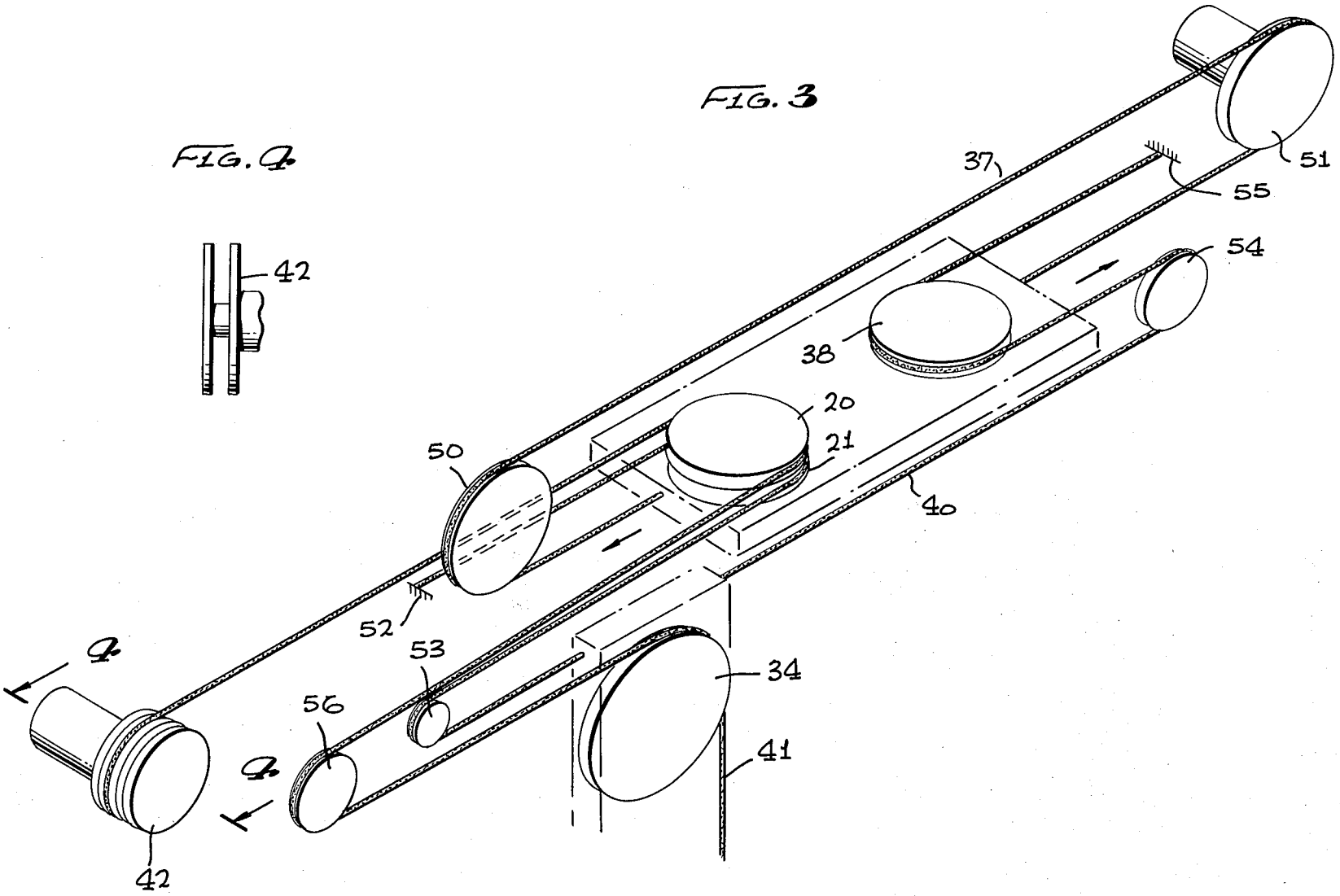
FIG. 3 is a simplified schemetic in perspective showing the pulley arrangement incorporated in the present invention for actuating the pair of carriages.
FIG. 4 is an end view of the take-up real for the lifting cable as taken in the direction of arrows 4—4 of FIG. 3.

Referring now in detail to FIG. 3, a schemetic illustration is provided which more readily may be used for describing the carriage means, the pulley system and the cabling attendant thereto. It can be seen that the first carriage means 17 can be moved back and forth by means of cable 37 which is anchored at its opposite ends to the carriage means 17. The cable 37 is drained about a free rotating pulley 50 and about a driving drum indicated by numeral 51. Driving may be manual or by any suitable mechanical means. It is to be noted that cable 40 is anchored to the support structure as indicated by numeral 52 at one of its ends and thereafter is trained about pulley 21 and redirected over an idler pulley 53 to attachment of the second carriage means 30. The cable 40 continues from attachment to the second carriage 30 about a second idler 54 where the cable is then trained about pulley 38 and terminates at its opposite end to the stationary support as indicated by numeral 55. The third cable 41 is attached to the hub of the drum 42 and is trained about pulley 20 where its direction is reversed so as to extend about a pulley 56 and then its direction reversed to ride on the lift pulley 34. The opposite end of the cable 41 is attached to a suitable harness for holding the performer.

The performer is moved in a horizontal plane by movement of the carriage means 17. A feature of the design is that the performer will remain at the same height throughout the length of the travel unless drum 42 is turned to either lift or lower the performer via cable 41. Thus, it is noted that an independent horizontal and vertical travel is provided and that such travel is only limited by the confines of the area in which the performance takes place and where the equipment is visible only the flying wires show from the equipment. The carrier means 17 controls the movement of the carriage means 30 which is slaved thereto and carriage means 30 moves in the opposite direction to the carriage means 17 and moves twice the distance.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A theatrical personnel transportation apparatus for positioning a performer in a vertical viewing plane having a portion thereof exposed to a viewing audience comprising:

an elongated stationary monorail lying in the vertical viewing plane out of view of the audience;

said monorail having an upper track and a lower track extending between the opposite ends of said monorail;

a first movable carriage carried on said upper track and a second movable carriage carried on said lower track whereby both of said carriages being adapted to move between the opposite ends of said tracks respectively;

a first pulley system having a plurality of pulley wheels and a line trained over said wheels wherein the opposite ends of said line are connected to the respective opposite ends of said carriage so that said carriage may be selectively moved along said upper track;

a second pulley system having a first pair of pulley wheels carried on said first carriage and a line trained over said pair of pulley wheels having its opposite ends fixly secured to said monorail whereby said second carriage moves in a direction opposite to the direction of movement of said first carriage and at twice the speed; and a third pulley system having a second pair of pulley wheels disposed so that one pulley wheel is mounted on said first carriage and the other pulley wheel of the pair is mounted on said second carriage and a line trained over said second pair of pulley wheels wherein the opposite ends of said line are connected to a wind-up drum and to the performer respectively whereby the performer is supported in mid-air from said monorail so that the performer may be maneuvered vertically and laterally within the vertical viewing plane exposed to the audience in response to movement of said first and second carriages respectively.

2. The invention as defined in claim 1 wherein:

the performer is moved in a horizontal plane by movement of said first carriage via said first pulley system and said second carriage.

3. The invention as defined in claim 2 wherein:

said performer is moved in a vertical plane by said third pulley system thereby providing independent horizontal and vertical travel of the performer.

4. The invention as defined in claim 3 wherein:

said line of said third pulley system winds upon itself on said wind-up drum whereby the speed of vertical lift of the performer will increase as the performer is lifted higher and conversely, the speed is decreased as the performer is lowered.

5. The invention as defined in claim 4 wherein:

said second pulley system includes a pair of idler pulleys carried on said monorail and disposed on opposite sides of said second carriage.

6. The invention as defined in claim 5 wherein:

said third pulley system includes an idler pulley carried on said monorail disposed between said carriage and said wind-up drum.

* * * * *